United States Patent [19]

Haugsjaa et al.

[11] 4,240,051

[45] Dec. 16, 1980

[54] HIGH FREQUENCY POWER COMBINER OR POWER DIVIDER

[75] Inventors: Paul O. Haugsjaa, Acton; Joseph M. Lech, Westford, both of Mass.

[73] Assignee: GTE Laboratories Incorporated, Waltham, Mass.

[21] Appl. No.: 53,499

[22] Filed: Jun. 29, 1979

[51] Int. Cl.[3] ..... H01P 5/12

[52] U.S. Cl. ..... 333/127; 331/56; 331/117 R; 333/128

[58] Field of Search ..... 333/123, 125, 127, 128, 333/136; 331/56

[56] References Cited

U.S. PATENT DOCUMENTS

| | | | |
|---|---|---|---|
| 2,963,664 | 12/1960 | Yeagley | 333/127 |
| 4,035,746 | 7/1977 | Covington, Jr. | 333/127 |
| 4,124,823 | 11/1978 | Sechi | 333/125 X |
| 4,163,955 | 8/1979 | Iden et al. | 333/127 |

*Primary Examiner*—Paul L. Gensler
*Attorney, Agent, or Firm*—William R. McClellan

[57] ABSTRACT

An apparatus for combining outputs of serially connected high frequency power sources includes a number of input ports, an output port, and a power combination structure. The power combination structure includes two outer conductive layers which extend from the input ports to the output port and one or more intermediate conductive layers which extend from the input ports to a power combination region. High frequency power from the input ports propagates to the power combination region and therein combines vectorially. The sum of the individual input power levels then propagates to the output port. The power combiner can be reversed and used as a power divider operating into serially connected loads. A preferred embodiment, including two copper clad dielectric members and an aluminum base, operates at about 915 MHz. The power combiner can be constructed in a coaxial configuration.

24 Claims, 10 Drawing Figures

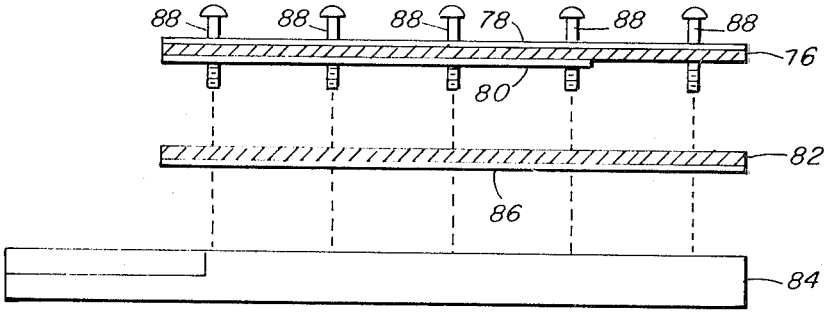
FIG. 4
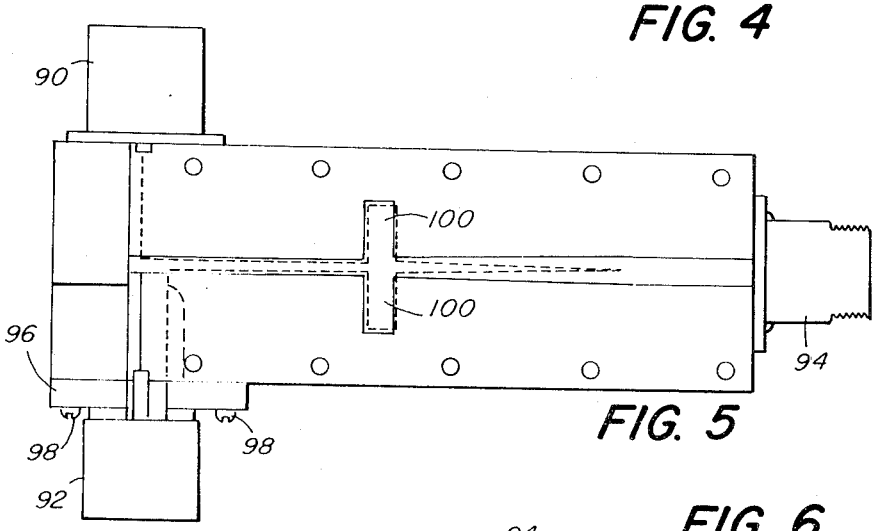
FIG. 5
FIG. 6
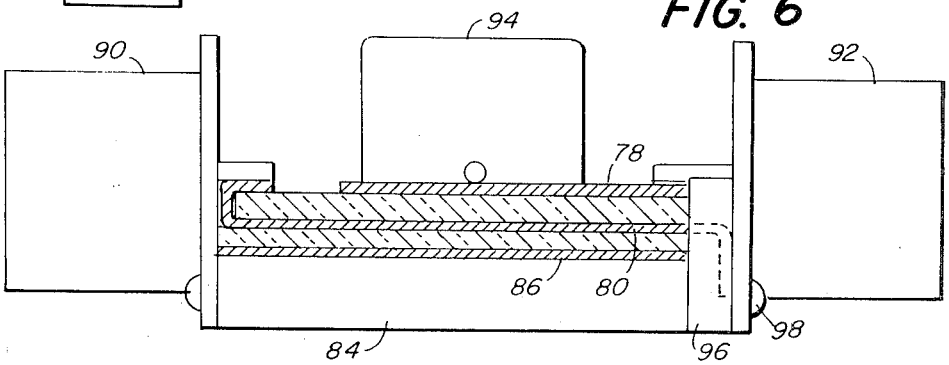
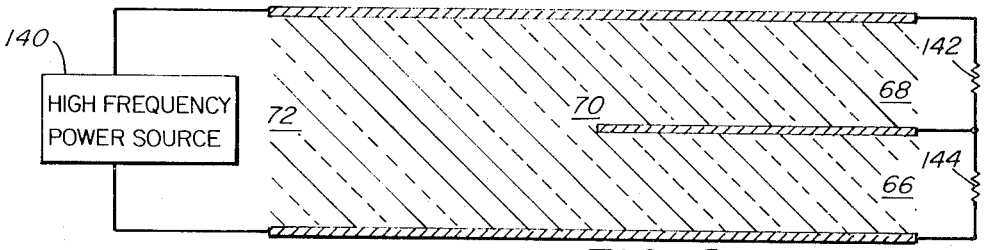
FIG. 8

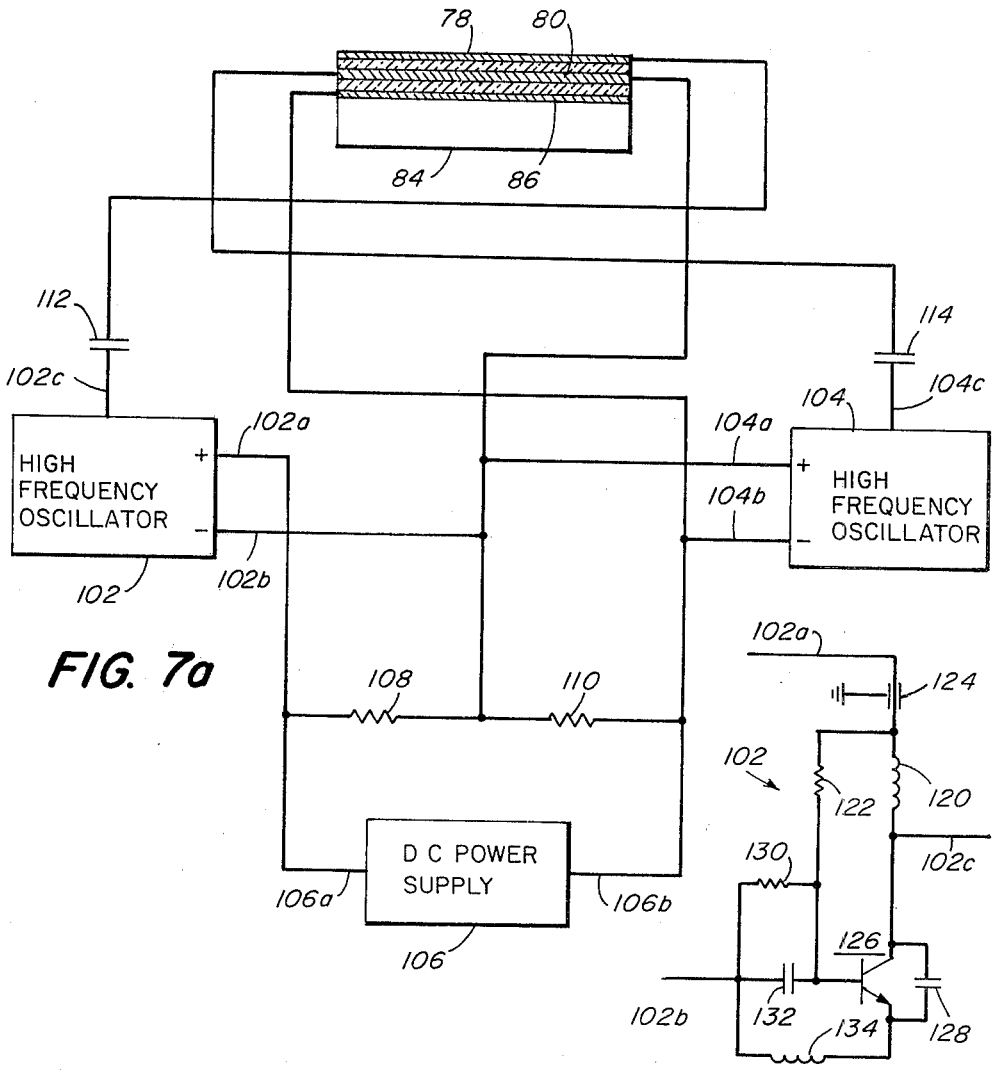
FIG. 7a
FIG. 7b
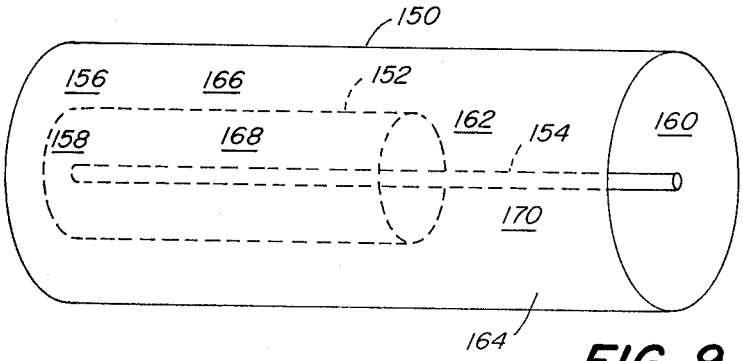
FIG. 9

HIGH FREQUENCY POWER COMBINER OR POWER DIVIDER

BACKGROUND OF THE INVENTION

This invention relates to apparatus for combining or dividing high frequency power. More particularly, this invention relates to apparatus for combining the outputs of serially connected high frequency power sources or for dividing high frequency power into serially connected loads.

In the past, high frequency power, such as rf or microwave power has been combined or split using coaxial T's or hybrid T's. These three port devices may or may not be impedance matched at each port, but all are intended for use with sources and loads having a common reference potential. While such devices are adequate to combine or split high frequency power when the sources and loads have a common reference potential, coaxial T's or hybrid T's are not useful for combining the outputs of serially connected high frequency power sources.

Since microwave transistors, diodes, and other solid state devices are inherently low voltage devices, it has been common practice to employ transformers to step down the 60 Hz ac line voltage to a level compatible with these microwave devices. Transformers suitable for use at 60 Hz are heavy, bulky, and expensive and are generally undesirable in high frequency power sources used in microwave appliances, communicaton systems and electrodeless light sources. However, when standard 60 Hz ac line voltage is rectified without the use of a transformer, the resulting voltage is well above 100 volts. One approach to operation without a transformer is to connect two or more high frequency devices in series across the high voltage thereby reducing the voltage applied to the individual devices. For example, two high frequency transistor oscillators can be connected in series across line voltage which has been rectified and filtered. The voltage applied to each oscillator and hence to each high frequency transistor is one half the total voltage. The series connection, however, results in two or more outputs, each having a different dc potential. It is necessary, therefore, to provide an apparatus for combining the outputs of the serially connected power sources.

SUMMARY OF THE INVENTION

According to the present invention, an apparatus for combining outputs of serially connected high frequency power sources includes a plurality of input ports, an output port, and a sandwiched power combination structure. Each of said power source outputs is coupled to a reference potential for the next serially connected power source. The plurality of input ports receives high frequency power from the outputs of the serially connected high frequency power sources.

The sandwiched power combination structure is configured to define a power combination region, a plurality of parallel input transmission lines coupled between the input ports and the power combination region, and an output transmission line coupled between the power combination region and the output port. The structure includes two outer conductive layers, at least one intermediate conductive layer, and a dielectric layer between each pair of adjacent conductive layers. The two outer conductive layers extend from the input ports to the power combination region to form outer conductors of the input transmission lines and extend from the power combination region to the output port to form the output transmission line. The intermediate conductive layer extends from the input ports to the power combination region to form an inner conductor of the input transmission lines and terminates in the power combination region thereby forming the region. The intermediate conductive layer acts as a power signal conductor for one input transmission line and as a reference potential conductor for the adjacent input transmission line. High frequency power from the serially connected power sources propagates along each of the parallel input transmission lines, combines in the power combination region, and propagates along the output transmission line to the output port.

According to another aspect of the present invention, the above-described apparatus is utilized to divide high frequency power into a plurality of serially connected loads. When the apparatus is used for dividing high frequency power, the above-described input ports become output ports and the output port becomes the input port.

According to yet another aspect of the present invention, an apparatus for combining outputs of serially connected high frequency power sources includes a plurality of input ports, an output port, and a coaxial power combination structure. The structure is configured to define a power combination region, a plurality of coaxial input transmission lines between the input ports and the power combination region, and a coaxial output transmission line between the power combination region and the output port. The structure includes an outer coaxial conductor, at least one intermediate coaxial conductor, a center conductor, and dielectric material between each pair of adjacent coaxial conductors. High frequency power from the serially connected power sources propagates along each of the coaxial input transmission lines, combines in the power combination region, and propagates along the coaxial output transmission line to the output port.

BRIEF DESCRIPTION OF THE DRAWINGS

In the Drawings:

FIG. 4 is an exploded side view of a power combiner constructed in accordance with the present invention.

FIG. 5 is a top view of a completed power combiner constructed in accordance with the present invention.

FIG. 6 is an end view of a completed power combiner constructed in accordance with the present invention.

FIG. 7*a* is a schematic diagram of a power combiner connected to serially connected power sources.

FIG. 7*b* is a schematic diagram of the high frequency oscillator utilized in the circuit of FIG. 7*a*.

FIG. 8 is a schematic diagram showing the apparatus of the present invention being used as a power divider.

FIG. 9 illustrates a coaxial power combiner in accordance with the present invention.

For a better understanding of the present invention, together with other and further objects, advantages and capabilities thereof, reference is made to the following disclosure and appended claims in connection with the above-described drawings.

DESCRIPTION OF THE PREFERRED EMBODIMENTS

Figure 1:
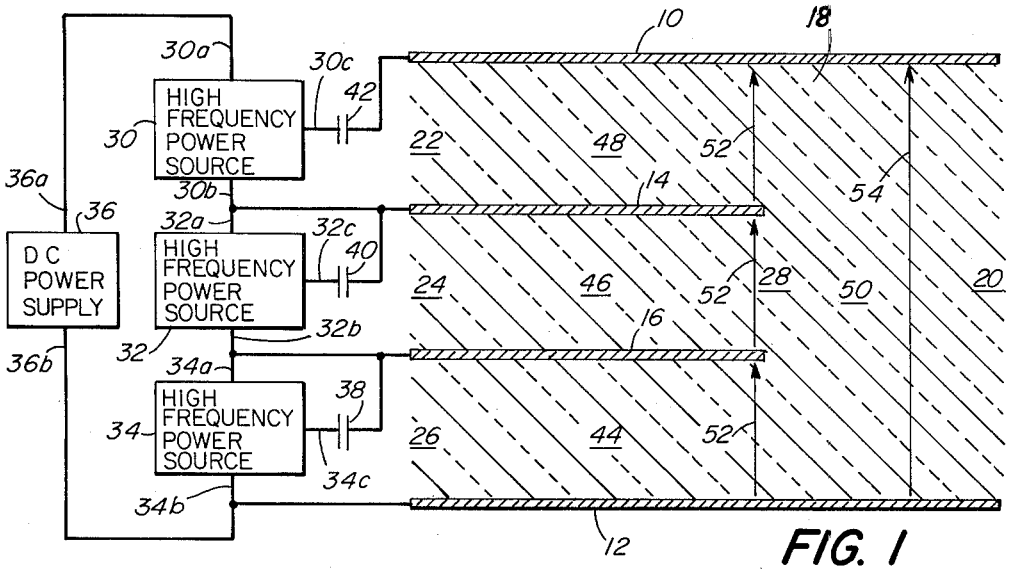
FIG. 1 is a schematic diagram of a power combiner connected to serially connected high frequency power sources.

An apparatus for combining the outputs of a plurality of serially connected high frequency power sources, or power combiner, is shown in FIG. 1 in schematic form. The apparatus includes a number of planar conductive layers in a sandwiched or stacked configuration. The apparatus includes outer conductive layers 10 and 12, intermediate conductive layers 14 and 16 and dielectric layers 18 between each pair of adjacent conductive layers. Also included in the power combiner are output port 20 and input ports 22, 24, and 26. Outer conductive layers 10 and 12 extend from input ports 22 and 26, respectively, to output port 20. Intermediate conductive layers 14 and 16 extend from input ports 22, 24, and 26 to a power combination region 28 where intermediate conductive layers 14 and 16 terminate. High frequency power sources 30, 32, and 34 and dc power supply 36 are shown to illustrate a typical connection of the power combiner to serially connected power sources. As used herein, the term "high frequency" refers to frequencies in the range from 1 MHz to 100 GHz. High frequency power sources 30, 32, and 34 are connected in series across the output of dc power supply 36. Each high frequency power source has a dc power supply terminal, a reference potential terminal and a high frequency output terminal. The reference potential terminal **34*b* of power source 34 is coupled to the reference potential terminal 36*b* of dc power supply 36 and to outer conductive layer 12. The power supply terminal 34*a* of power source 34 is coupled to the reference potential terminal 32*b* of power source 32 and to intermediate conductive layer 16. High frequency output terminal 34*c* of power source 34 is coupled through capacitor 38 to intermediate conductive layer 16. The power supply terminal 32*a* of power source 32 is coupled to the reference potential terminal 30*b* of power 30 and to intermediate conductive layer 14. High frequency output terminal 32*c* of power source 32 is coupled through capacitor 40 to intermediate conductive layer 14. The power supply terminal 30*a* of power source 30 is coupled to the output terminal 36*a* of dc power supply 36. High frequency output terminal 30*c* of power source 30 is coupled through capacitor 42 to output conductive layer 10**.

High frequency power from power source 34 is received by input port 26 and propagates along input transmission line 44 formed by outer conductive layer 12 and intermediate conductive layer 16 to power combination region 28. High frequency power from power source 32 is received by input port 24 and propagates along input transmission line 46 formed by intermediate conductive layers 14 and 16 to power combination region 28. High frequency power from power source 30 is received by input port 22 and propagates along input transmission line 48 formed by intermediate conductive layer 14 and outer conductive layer 10 to power combination region 28. It can be seen that intermediate conductive layers 14 and 16 each serve as the signal carrying conductor for one input transmission line and the reference potential conductor for the adjacent input transmission line.

When high frequency power propagating along input transmission lines 44, 46, and 48 reaches power combination region 28, where intermediate conductive layers 14 and 16 terminate, it is launched into output transmission line 50 formed by outer conductive layers 10 and 12. If power sources 30, 32, and 34 operate at the same frequency and are in phase, then the high frequency power reaching combination region 28 along each input transmission line is in phase providing that input transmission lines 44, 46, and 48 have equal electrical lengths. Therefore, the high frequency power launched into output transmission line 50 is in phase and the power propagating along output transmission line 50 to output port 20 is the sum of the high frequency power received at input ports 22, 24, and 26. The summation or combination is illustrated in FIG. 1 by electric fields 52 in each input transmission line which are combined in region 28 to form a total electric field 54 in output transmission line 50. In general, power sources 30, 32, and 34 can have different frequencies and different phases. In this situation, the power reaching combination region 28 combines vectorially.

The power combiner shown in FIG. 1 has two intermediate conductive layers and combines the outputs of three serially connected power sources. In general, the apparatus can have one or more intermediate conductive layers. The conductive layers are not necessarily planar according to the present invention, nor is uniform spacing of the conductive layers required.

It is desirable for efficient operation of the power combination apparatus to avoid large changes in impedance which can cause reflections of the high frequency input power. The particular area where impedance changes are a problem is the power combination region because the intermediate conductive layers terminate therein. The impedance of each input transmission line and the output transmission line depends on the width of the conductive layers, the spacing of the conductive layers and the permittivity of the dielectric material. Therefore, the impedance can be controlled by varying these parameters.

Figure 2:
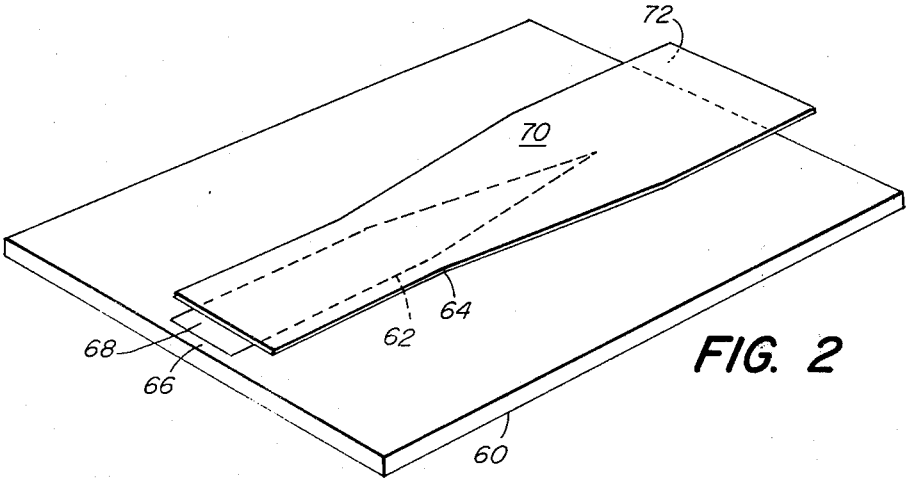
FIG. 2 is a perspective view of a two input power combiner illustrating the shape and relation of the conductors.

A preferred embodiment of the sandwiched power combination apparatus is shown in FIG. 2 in simplified form for purposes of clarity. The apparatus includes outer conductive layer 60, intermediate conductive layer 62, spaced above outer conductive layer 60, and outer conductive layer 64 spaced above intermediate conductive layer 62. The three conductive layers are planar and parallel. the spacing between outer conductive layer 60 and intermediate conductive layer 62 is equal to the spacing between outer conductive layer 64 and intermediate conductive layer 62. High frequency input power is received at input port 66 and input port 68, propagates along conductive layers 60, 62, and 64 to power combination region 70. The power combines in region 70 as above described and propagates along outer conductive layers 60 and 64 to output port 72.

The widths of conductive layers 62 and 64 have been chosen in the apparatus of FIG. 2 to maintain a constant characteristic impedance between input ports 66 and 68 and output port 72. In order to obtain equal input impedances at input ports 66 and 68, the width of outer conductive layer 64 is twice that of intermediate conductive layer 62 in the region between input ports 66 and 68 and power combination region 70. Intermediate conductive layer 62 is tapered from full width to zero width in power combination region 70. This is done to avoid abrupt changes in impedance in the power combiner. To compensate for the change in impedance brought about by the tapering of intermediate conductive layer 62, outer conductive layer 64 is increased in width in power combination region 70. Outer conductive layer 64 is maintained at the increased width between power combination region 70 and output port 72.

Figure 3:
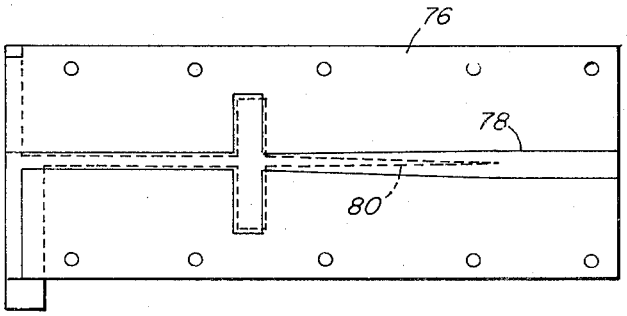
FIG. 3 is a top view of the upper layer of a power combiner constructed in accordance with the present invention.

Another preferred embodiment of the power combiner in accordance with the present invention is shown in detail in FIGS. 3, 4, 5, and 6. While the embodiment described below is illustrative of the present invention, it will be obvious to those skilled in the art that many other configurations and dimensions come within the scope of the present invention. The power combiner includes top and bottom members of copper clad dielectric. Top member 76 is shown in FIG. 3. Each member of copper clad dielectric is a sheet of dielectric 0.031 inch thick, having a permittivity of 2.55, with a film of copper adhered to both sides. The copper can be selectively removed from either side to create any desired copper conductive pattern. The copper patterns on top member 76 are outer conductive layer 78 (solid lines) and intermediate conductive layer 80 (dashed lines).

Top member 76, bottom member 82, and conductive base 84 which can be aluminum are shown in FIG. 4. Top member 76 has outer conductive layer 78 and intermediate conductive layer 80 as shown in FIG. 3. Bottom member 82 has all copper removed from its top surface while all copper remains on the bottom surface to form outer conductor 86. Top member 76 and bottom member 82 are both approximately 4 inches long by 1.5 inches wide. Base 84 serves as a mounting base for the power combiner apparatus. Top member 76, bottom member 82, and base 84 are secured together with screws 88 to form the sandwiched power combiner structure. Base 84 makes electrical contact with outer conductor 86.

Referring now to FIGS. 5 and 6, the complete power combiner assembly includes coaxial connectors 90, 92, and 94. Coaxial connectors 90, 92, each of which can be AMP model 49000, form input ports and coaxial connector 94, which can be UG58 A/U, forms an output port. Input connector 90 has its outer conductor connected to aluminum base 84 and its center conductor connected to intermediate conductive layer 80. Input connector 92 has its outer conductor coupled to intermediate conductive layer 80. Since the outer conductor of input connector 92 is also used for mounting of the connector, the outer conductor is electrically isolated from aluminum base 84 by nylon insulator 96 and nylon screws 98. Input connector 92 has its center conductor coupled to outer conductive layer 78. Output connector 94 has its outer conductor coupled to aluminum base 84 and its center conductor coupled to outer conductive layer 78.

The power combiner apparatus shown in FIG. 5 was intended for operation at 915 MHz. The width of outer conductive layer 78 was 0.080 inch in the input region and increased to 0.156 inch in the output region. The width of intermediate conductive layer 80 was 0.040 inch in the input region and tapered to zero width as shown. The operation of the power combiner is not dependent on the length of the conductive layers therefore providing inherently wide band pass capabilities. In this embodiment, however, a capacitive tuning structure 100 was used to fine tune the impedances of the apparatus. This simple tuning method introduces some frequency dependence that would not be present if tuning were accomplished, for example, by trimming line widths. Capacitive tuning structure 100 includes overlapping regions in outer conductive layer 78 and intermediate conductive layer 80 and is believed to have the effect of a lumped element capacitor. The power combiner shown in FIGS. 3–6 can be operated at frequencies from 1 MHz to 100 GHz by appropriate changes in the dimensions of capacitive tuning structure 100.

A circuit used to operate the power combiner of FIGS. 5 and 6 is shown in FIGS. *7a* and *7b*. Identical high frequency oscillators 102 and 104 are connected in series across dc power supply 106. Resistors 108 and 110 are coupled in series across dc power supply 106 to establish stable dc outputs at one half the supply voltage. The reference terminal **106*b* of dc power supply 106 is coupled to one end of resistor 110, to reference terminal 104*b* of high frequency oscillator 104, and to outer conductive layer 86 of the power combiner. The positive terminal 106*a* of dc power supply 106 is coupled to one end of resistor 108 and to positive terminal 102*a* of high frequency oscillator 102. The other ends of resistors 108 and 110 are coupled together and to positive terminal 104*a* of high frequency oscillator 104, to reference terminal 102*b* of high frequency oscillator 102, and to intermediate conductive layer 80 of the power combiner. The output 102*c* of high frequency oscillator 102 is coupled through capacitor 112 to outer conductive layer 78 of the power combiner. The output 104*c* of high frequency oscillator 104 is coupled through capacitor 114 to intermediate conductive layer 80** of the power combiner. In FIG. *7a*, capacitors 112 and 114 can be 36 picofarads and resistors 108 and 110 can be 2.5 ohms at 300 watts.

High frequency oscillator 102 is shown in more detail in FIG. *7b*. Oscillator 104 is identical to oscillator 102. Positive terminal **102*a* is coupled to one side of inductor 120, which can be 0.1 microhenry, and to one side of resistor 122, which can be 1.8 kilohms. Decoupling capacitor 124, which can be 47 picofarads, is coupled from positive terminal 102*a* to ground. The other side of inductor 120 is coupled to the collector of transistor 126, which can be a CTC D10-2B, to one side of capacitor 128, which can be 1.6 picofarads, and to output terminal 102*c*. The other side of resistor 122 is coupled to the base of transistor 126, to one side of resistor 130, which can be 100 ohms, and to one side of capacitor 132, which can be 18 picofarads. The other side of capacitor 128 is coupled to the emitter of transistor 126 and to one side of inductor 134, which can be 0.1 microhenry. The other side of resistor 130 is coupled to the other side of capacitor 132, the other side of inductor 134 and to reference terminal 102*b*. Oscillator 102** operates in the approximate frequency range of 915 MHz.

Two oscillators constructed as shown in FIG. *7b* delivered 2.55 watts and 2.20 watts of power when supplied with 18 volts dc, at frequencies of 910 MHz and 911 MHz, respectively. When these oscillators were connected to the power combiner as shown in FIG. *7a* and were supplied with 36 volts dc, the power combiner output delivered 4.48 watts at 894.9 MHz. Both oscillators operated at the same frequency and phase. Clearly, the operating frequencies of the particular oscillators were load sensitive. However, since the two oscillators locked in frequency and phase, it is believed that a small amount of power reflected from the output port causes injection locking of the oscillators.

The power combiner can be initially aligned by reversing the connections to the input and output ports. A test power source was coupled to the output port and power meters were coupled to the input ports which were terminated in 50 ohm loads. The parameters of the power combiner, such as conductive layer width, were adjusted until equal power was delivered to each 50 ohm load. Then the test power source, the power meters, and the 50 ohm loads were removed and oscillators 102 and 104 were coupled to the power combiner as shown in FIG. 7*a*. It was found that adjusting the length of cable between the oscillators and the input ports of the power combiner assists the phase and frequency locking of the oscillators.

The power combiner shown in FIGS. 3, 4, 5 and 6 utilizes variable width conductive layers to control the characteristic impedance in the power combination region. As discussed above, the characteristic impedance depends not only on the conductive layer width but also on the spacing of the conductive layers and the permittivity of the dielectric material. Therefore, alternative means of impedance control can be used. For example, the width of the conductive layers can be constant with the intermediate conductive layers having an abrupt termination, but the spacing of the conductive layers can be varied in the power combination region. Alternatively, the permittivity of the dielectric material can be varied in the power combination region. Also, the characteristic impedance can be controlled by varying the above-mentioned parameters in combination.

The power combiner apparatus described above can be used for dividing high frequency power into a plurality of serially connected loads due to the passive nature of the apparatus. This function is provided by reversing the input and output ports. Referring now to FIG. 8, there is illustrated a power combiner being utilized as a power divider. Since the power divider shown in FIG. 8 can be identical in construction to the power combiner shown in FIG. 2, the detailed description is not repeated. High frequency power source 140 is coupled to output port 72 which acts as an input port in this configuration. Resistive load 142 is coupled to input port 68 which acts as an output port in this configuration. Resistive load 144 is coupled to input port 66 which acts as an output port in this configuration. Resistive loads 142 and 144 are serially connected. High frequency power received by port 72 propagates to power combination region 70 which acts as a power division region in this configuration. The high frequency power is then divided, in a reversal of the process described above for power combination, and propagates to ports 66 and 68 where the power is delivered to loads 142 and 144.

The passive nature of the power combiner apparatus also permits cascade connections of the power combiners to achieve any desired degree of complexity. That is, the output port of one power combiner can be connected to the input port of a second power combiner. The input and output impedances of the power combiners should be equal for optimum operation.

The foregoing description has focussed on sandwiched or stacked power combiners and power dividers which include conductive layers. The same functions can be performed by forming the conductive layers into a closed surface, thus forming a coaxial structure as shown in FIG. 9. The coaxial power combiner apparatus includes an outer coaxial conductor 150, and intermediate coaxial conductor 152, and a center conductor 154. Outer coaxial conductor 150 and center conductor 154 extend from input ports 156 and 158 to output port 160. Intermediate coaxial conductor 152 extends from input ports 156 and 158 to power combination region 162. Dielectric material 164 fills the spaces between outer coaxial conductor 150, intermediate coaxial conductor 152, and center conductor 154.

The coaxial power combiner can be coupled to serially connected high frequency power sources in the same manner as shown in FIG. 7*a*. High frequency power is received by input port 156 and propagates along coaxial input transmission line 166 formed by outer coaxial conductor 150 and intermediate coaxial conductor 152 to power combination region 162. High frequency power is received by input port 158 and propagates along coaxial input transmission line 168 formed by intermediate coaxial conductor 152 and center conductor 154 to power combination region 162. If the power propagating along transmission lines 166 and 168 has the same frequency and phase, the high frequency power launched into coaxial output transmission line 170, formed by outer coaxial conductor 150 and center conductor 154, is in phase. Therefore, the power propagating along coaxial output transmission line 170 to output port 160 is the sum of the high frequency power levels received at input ports 156 and 158.

In general, the coaxial power combiner has the same features as the sandwiched power combiner. Several intermediate coaxial conductors can be utilized. The impedances can be controlled by varying the spacing of the conductors or the permittivity of the dielectric material. The power combiner can be reversed and used as a power divider. The cross section of the coaxial structure can have various shapes in addition to circular.

While there has been shown and described what is at present considered the preferred embodiments of the invention, it will be obvious to those skilled in the art that various changes and modifications may be made therein without departing from the scope of the invention as defined by the appended claims.

We claim:

1. An apparatus for combining outputs of a plurality of serially connected high frequency power sources, each of said power source outputs being coupled to a reference potential for the next serially connected power source, said apparatus comprising:

a plurality of input ports, each having a different reference potential, for receiving high frequency power from the outputs of said serially connected high frequency power sources;

an output port; and a sandwiched power combination structure configured to define a power combination region, a plurality of parallel input transmission lines coupled between said input ports and said power combination region, and an output transmission line coupled between said power combination region and said output port, said structure including two outer conductive layers which extend from said input ports to said power combination region to form outer conductors of said input transmission lines and which extend from said power combination region to said output port to form said output transmission line, at least one intermediate conductive layer which extends from said input ports to said power combination region to form an inner conductor of said input transmission lines and which terminates in said power combination region, thereby forming said region, said intermediate conductive layer acting as a power signal conductor for one input transmission line and as a reference potential conductor for the adjacent input transmission line, and a dielectric layer between each pair of adjacent conductive layers whereby high frequency power from said serially connected power sources propagates along each of said parallel input transmission lines, combines in said power combination region, and propagates along said output transmission line to said output port.

2. The apparatus as defined in claim 1 wherein said input transmission lines, said output transmission line, and said power combination region each have a characteristic impedance, wherein each of said conductive layers has a width and wherein the width of said conductive layers is varied to control said characteristic impedance from each input port to said output port.

3. The apparatus as defined in claim 2 wherein said intermediate conductive layer is tapered from full width to zero width in said power combination region.

4. The apparatus as defined in claim 3 wherein at least one of said outer conductive layers is increased in width in said power combination region.

5. The apparatus as defined in claim 4 wherein said conductive layers are planar.

6. The apparatus as defined in claim 5 wherein said conductive layers are parallel.

7. The apparatus as defined in claim 6 wherein the characteristic impedances of said input transmission lines, said output transmission line, and said power combination region are substantially equal.

8. The apparatus as defined in claim 7 wherein said power combination structure includes one intermediate conductive layer.

9. The apparatus as defined in claim 8 further including a region wherein at least two of said conductive layers have increased width to form a capacitive tuning structure.

10. The apparatus as defined in claim 1 wherein said input transmission lines, said output transmission line, and said power combination region each have a characteristic impedance, wherein each adjacent pair of conductive layers has a spacing separation, and wherein the separation of said conductive layers is varied to control said characteristic impedance from each input port to said output port.

11. The apparatus as defined in claim 10 wherein said power combination structure includes one intermediate conductive layer.

12. The apparatus as defined in claim 1 wherein said input transmission lines, said output transmission line, and said power combination region each have a characteristic impedance, wherein said dielectric layers have a permittivity, and wherein the permittivity of said dielectric layers is varied to control said characteristic impedance from each input port to said output port.

13. The apparatus as defined in claim 12 wherein the characteristic impedances of said input transmission lines, said output transmission line, and said power combination region are substantially equal.

14. The apparatus as defined in claim 13 wherein said power combination structure includes one intermediate conductive layer.

15. An apparatus for dividing high frequency power into a plurality of serially connected loads, said apparatus comprising:

an input port for receiving high frequency power;

a plurality of output ports, each having a different reference potential, for connection to said plurality of serially connected loads;

a sandwiched power division structure configured to define a power division region, a plurality of parallel output transmission lines coupled between said output ports and said power division region, and an input transmission line coupled between said power division region and said input port, said structure including two outer conductive layers which extend from said output ports to said power division region to form outer conductors of said output transmission lines and which extend from said power division region to said input port to form said input transmission line, at least one intermediate conductive layer which extends from said output ports to said power division region to form an inner conductor of said output transmission lines and which terminates in said power division region, thereby forming said region, said intermediate conductive layer acting as a power signal conductor for one output transmission line and as a reference potential conductor for the adjacent output transmission line, and a dielectric layer between each pair of adjacent conductive layers whereby high frequency power propagates along said input transmission line, divides in said power division region, and propagates along each of said output transmission lines to said output ports.

16. The apparatus as defined in claim 15 wherein said input transmission line, said output transmission lines, and said power division region each have a characteristic impedance, wherein each of said conductive layers has a width and wherein the width of said conductive layers is varied to control said characteristic impedance from said input port to each output port.

17. The apparatus as defined in claim 16 wherein said intermediate conductive layer is tapered from full width to zero width in said power division region.

18. The apparatus as defined in claim 17 wherein at least one of said outer conductive layers is increased in width in said power division region.

19. The apparatus as defined in claim 18 wherein said conductive layers are planar.

20. The apparatus as defined in claim 19 wherein said conductive layers are parallel.

21. The apparatus as defined in claim 20 wherein the characteristic impedances of said input transmission line, said output transmission lines, and said power division region are substantially equal.

22. The apparatus as defined in claim 21 wherein said power division structure includes one intermediate conductive layer.

23. The apparatus as defined in claim 22 further including a region wherein at least two of said conductive layers have increased width to form a capacitive tuning structure.

24. An apparatus for combining outputs of a plurality of serially connected high frequency power sources, each of said outputs being coupled to a reference potential for the next serially connected power source, said apparatus comprising:

a plurality of input ports, each having a different reference potential, for receiving high frequency power from the outputs of said serially connected high frequency power sources;

an output port; and a coaxial power combination structure configured to define a power combination region, a plurality of coaxial input transmission lines between said input ports and said power combination region, and a coaxial output transmission line between said power combination region and said output port, said structure including an outer coaxial conductor which extends from said input ports to said power combination region to form an outer conductor of said coaxial input transmission lines and which extends from said power combination region to said output port to form an outer conductor of said coaxial output transmission line, at least one intermediate coaxial conductor which extends from said input ports to said power combination region to form an inner conductor of said coaxial input transmission lines and which terminates in said power combination region, thereby forming said region, said intermediate coaxial conductor acting as a power signal conductor for one coaxial input transmission line, and as a reference potential conductor for the adjacent coaxial input transmission line, a center conductor which extends from said input ports to said power combination region to form a center conductor of said coaxial input transmission lines and which extends from said power combination region to said output port to to form a center conductor of said coaxial output transmission line, and a dielectric material between each pair of adjacent coaxial conductors whereby high frequency power from said serially connected power sources propagates along each of said coaxial input transmission lines, combines in said power combination region, and propagates along said coaxial output transmission line to said output port.

* * * * *